US006761647B2

(12) United States Patent
Kasashima

(10) Patent No.: US 6,761,647 B2
(45) Date of Patent: Jul. 13, 2004

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/414,031

(22) Filed: Apr. 16, 2003

(65) Prior Publication Data

US 2003/0232667 A1 Dec. 18, 2003

(30) Foreign Application Priority Data

Apr. 17, 2002 (JP) ..... 2002-114913
Jun. 28, 2002 (JP) ..... 2002-188968

(51) Int. Cl.[7] ..... A63B 37/14
(52) U.S. Cl. ..... 473/378; 473/383
(58) Field of Search ..... 473/378, 379, 473/380, 381, 382, 383, 384, 385

(56) References Cited

U.S. PATENT DOCUMENTS 5,957,786 A * 9/1999 Aoyama ..... 473/379
6,358,161 B1 3/2002 Aoyama
6,682,442 B2 * 1/2004 Winfield ..... 473/383

* cited by examiner

*Primary Examiner*—Raeann Gorden
(74) *Attorney, Agent, or Firm*—Sughrue Mion, PLLC

(57) ABSTRACT

In a golf ball having a plurality of dimples on its surface, twelve pentagonal groups each consisting of five dimples arranged about one central dimple are dispersively distributed over the ball surface excluding the polar areas, and hexagonal groups each consisting of six dimples arranged about one central dimple are distributed over the remaining area of the ball surface. The dimples are arranged uniformly and densely so as to reduce the air resistance in flight of the ball, resulting in increased flight distance.

9 Claims, 12 Drawing Sheets

GOLF BALL

TECHNICAL FIELD

This invention relates to a golf ball having dimple groupings optimized for excellent aerodynamic performance.

BACKGROUND ART

In general, golf balls have a plurality of dimples on their surface for improving the aerodynamic performance thereof. In order that the golf ball as launched travel a longer carry, the rebound upon impact of the ball itself and the reduced air resistance of the ball in flight due to the arrangement of dimples on the ball surface are key factors as is well known in the art. In connection with the reduction of air resistance, a number of methods have been proposed for arranging dimples throughout the ball surface as uniformly and densely as possible. One typical dimple arrangement uses as base units hexagonal groups each having seven, in total, circular dimples assembled together, establishing a high density dimple arrangement.

However, the above-mentioned dimple arrangement is still insufficient in uniformity of dimple distribution and difficult to distribute dimples uniformly and closely throughout the ball's spherical surface. Besides, regular polyhedral dimple arrangement patterns such as regular octahedral and icosahedral patterns are also known, but yet somewhat deficient in close packing of dimples.

SUMMARY OF THE INVENTION

An object of the present invention is to provide a golf ball having a plurality of dimples arranged as uniformly and densely as possible for imparting improved flight uniformity and flight performance.

The invention relates to a golf ball having a pair of opposed poles and a plurality of dimples on its surface. It has been found that when pentagonal groups each consisting of five dimples arranged about one central dimple are dispersively distributed at twelve locations over the ball surface excluding the polar areas, and hexagonal groups each consisting of six dimples arranged about one central dimple are distributed over the remaining area of the ball surface, the dimples can be arranged uniformly and at a high density so that the ball is endowed with uniform behavior in flight and significantly improved in distance.

According to the present invention, there is provided a golf ball having a pair of poles and a plurality of dimples on its surface, wherein twelve pentagonal groups each consisting of five dimples arranged about one central dimple are dispersively distributed over the ball surface excluding the polar areas, and hexagonal groups each consisting of six dimples arranged about one central dimple are distributed over the remaining area of the ball surface. The term "dispersively" means that the pentagonal groups are spaced apart from each other.

In a preferred embodiment, the central dimple of the hexagonal group is located at or near either pole of the ball.

In another preferred embodiment, a portion of the pentagonal group constitutes a portion of the hexagonal group.

The dimples are circular in most cases. In one embodiment, except for those dimples located at the center of the pentagonal groups, the dimple edges delimiting each dimple define together a hexagonal shape.

The golf ball has between the pair of poles an equator by which the ball is divided into a pair of hemispheres. In a preferred embodiment, six pentagonal groups are dispersively distributed on one hemisphere and six pentagonal groups are dispersively distributed on the other hemisphere.

Preferably, the pentagonal groups are distributed in symmetry with respect to an axis of rotation that connects the pair of poles.

Also preferably, the total of dimple areas accounts for at least 77% of the entire surface area of the golf ball.

In the pentagonal group, the central dimple is smaller than the surrounding dimples. In an alternative embodiment, the central dimple in the pentagonal group is not smaller than the surrounding dimples.

DESCRIPTION OF THE PREFERRED EMBODIMENTS

The golf ball has a plurality of dimples on its spherical surface. For brevity of description, the ball is regarded as having a pair of opposed poles and an equator which divides the ball into a pair of hemispheres. The dimples are circular in planar shape in all the embodiments except for the tenth embodiment of FIGS. 19 and 20.

Figure 1:
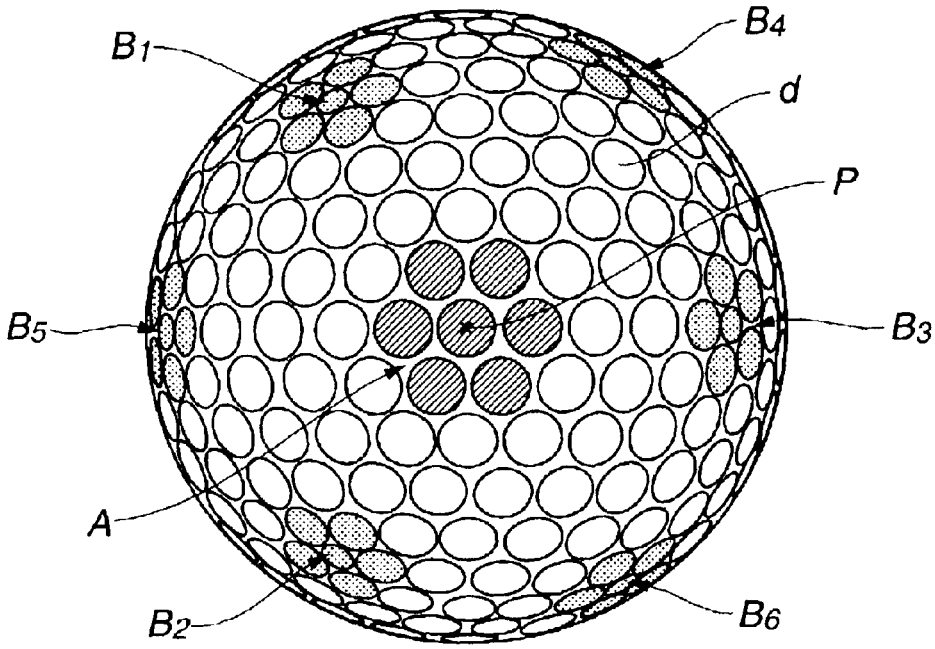
FIG. 1 is a plan view, as viewed from above the pole, of a golf ball according to a first embodiment of the invention.
Figure 2:
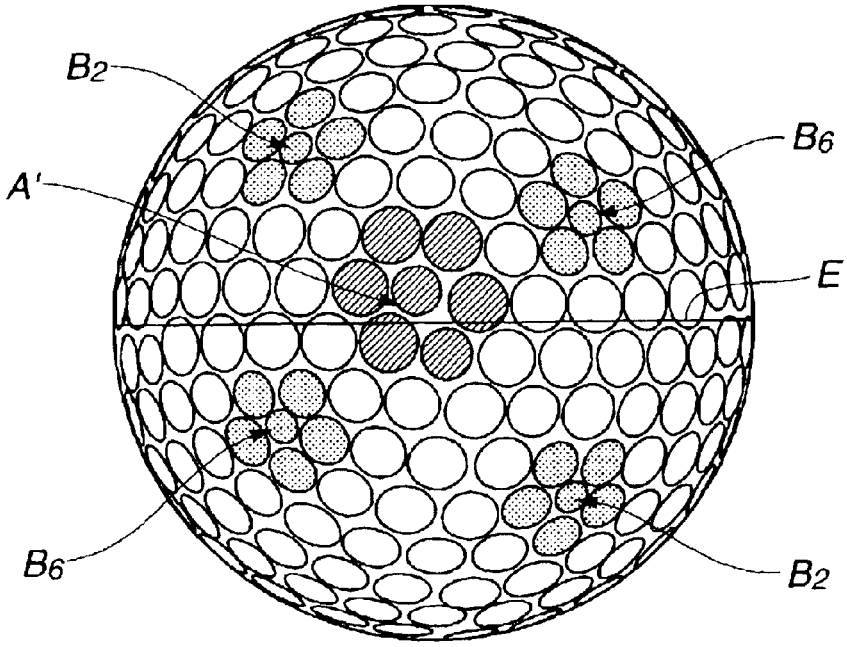
FIG. 2 is a side view, as viewed from above the equator, of the golf ball of FIG. 1.

Referring to FIGS. 1 and 2, there is illustrated a golf ball according to the first embodiment of the invention. FIG. 1 is a plan view of the ball as viewed from above the pole P. FIG. 2 is a side view of the ball as viewed from above the equator E.

In the golf ball according to the first embodiment, all the dimples arranged on the spherical surface are dimples d of circular shape as viewed in plane, but different in size. The dimples are grouped into pentagonal groups Bn in which one relatively small dimple is located at the center and five relatively large dimples are arranged about the central dimple and closely spaced apart from each other and hexagonal groups A or A' in which one dimple is located at the center and six dimples are arranged about the central dimple and closely spaced apart from each other. Twelve pentagonal groups Bn (B1 to B6 are shown in FIG. 1) are dispersively distributed over the ball surface excluding the polar areas (i.e., north and south-polar areas), and hexagonal groups A and A' are distributed over the remaining area of the ball surface. Note that the dimples belonging to the pentagonal group are dotted in FIGS. 1 and 2.

More specifically, on one hemisphere (northern hemisphere), first, second and third pentagonal groups B1, B2 and B3 each consisting of the smallest dimple of circular planar shape as the center and closely spaced five dimples of a larger diameter arranged about the central dimple are evenly distributed at intervals of 120° along a certain concentric circle about the pole P (or at a certain latitude). Fourth, fifth and sixth pentagonal groups B4, B5 and B6 (each consisting of the smallest dimple as the center and closely spaced five dimples of a larger diameter arranged about the central dimple) are distributed at intervals of 120° along a larger concentric circle about the pole P (or at a lower latitude). As seen from FIG. 2, pentagonal groups B1 to B6 are similarly distributed on the surface of the other hemisphere (southern hemisphere). Only second and sixth pentagonal groups B2 and B6 are seen in FIG. 2. The positional relationship of these pentagonal groups is symmetrical with respect to an axis of rotation that connects the pair of poles P, P.

More specifically, among the six pentagonal groups on one hemisphere (northern hemisphere) shown in FIG. 1, the first, second and third pentagonal groups B1, B2 and B3 are distributed symmetrically and at intervals of 120° about the axis of rotation P-P and the fourth, fifth and sixth pentagonal groups B4, B5 and B6 are also distributed symmetrically and at intervals of 120° about the axis of rotation. On the other hemisphere (southern hemisphere), first to third and fourth to sixth pentagonal groups B1 to B3 and B4 to B6 are distributed symmetrically and at intervals of 120° about the axis of rotation.

In the first embodiment illustrated herein, the region other than the pentagonal groups is filled with hexagonal groups of dimples. More specifically, as shown by hatched dimples in FIG. 1, a hexagonal group is formed in which one dimple is aligned with the pole P and six dimples of substantially the same size (diameter) are arranged about the central dimple and closely spaced apart from each other. The relationship of dimples in the hexagonal group applies to adjacent dimples lying in succession. That is, provided that any one of the dimples disposed adjacent to the dimple located at the pole P is the center, it forms a hexagonal group with six surrounding dimples. Moreover, provided that any dimple spaced from the dimple located at the pole P by two or three or more dimples in any arbitrary direction is the center, it forms a hexagonal group with six surrounding dimples as well. This relationship continues until the dimples reach the pentagonal group. That is, a portion (one or more dimples) of the pentagonal group constitutes a portion (one or more dimples) of the hexagonal group. Specifically, the dimple groups are distributed such that when any desired one of the dimples except for the small diameter dimple located at the center of the pentagonal group is considered to be the center, it substantially forms a hexagonal group with six surrounding dimples. It is noted that in the illustrated embodiment, dimples are distributed at such a high density that a great circle that does not intersect with dimples is absent. In the illustrated embodiment, the total number of dimples is 380. The distribution density of dimples is preferably such that the total of dimple areas accounts for at least 77% of the surface area of the ball which is assumed to be dimple free.

Figure 3:
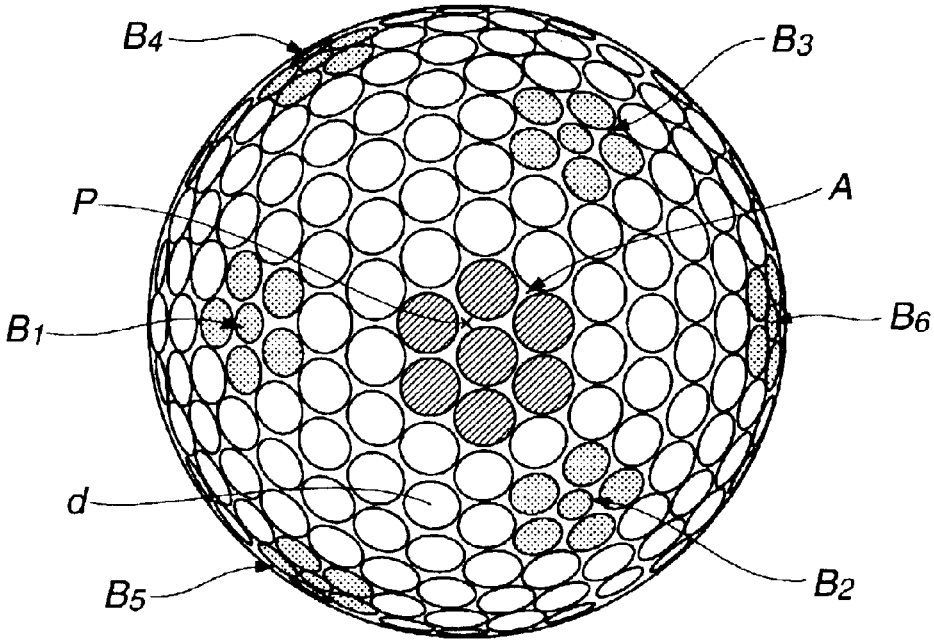
FIG. 3 is a plan view, as viewed from above the pole, of a golf ball according to a second embodiment of the invention.
Figure 4:
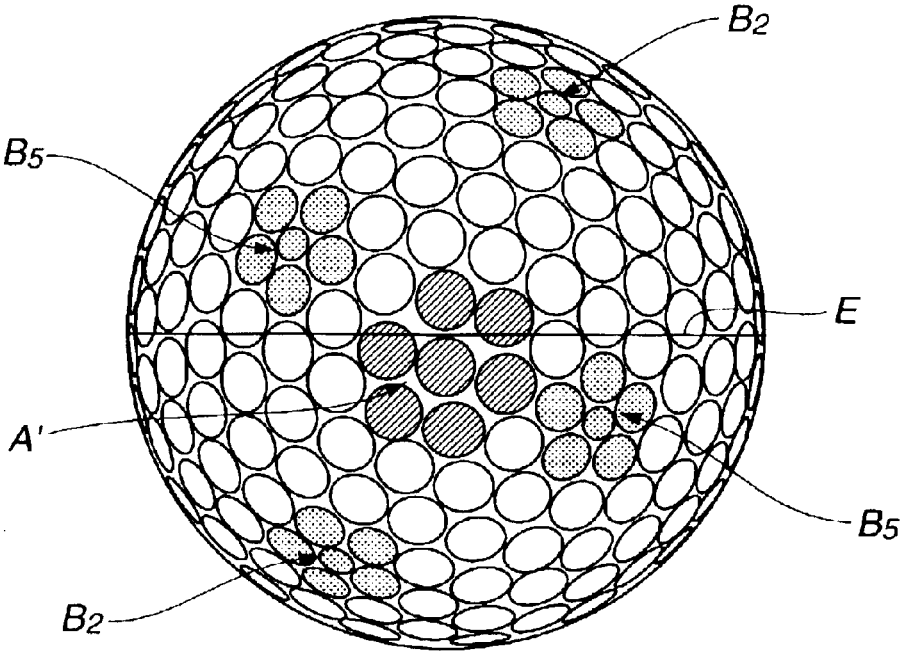
FIG. 4 is a side view, as viewed from above the equator, of the golf ball of FIG. 3.

FIGS. 3 and 4 illustrate a golf ball according to the second embodiment of the invention. FIG. 3 is a plan view of the ball as viewed from above the pole P. FIG. 4 is a side view of the ball as viewed from above the equator E. The second embodiment is characterized in that for a hexagonal group A located at the polar area of the ball surface, the center of the hexagonal group is somewhat offset from the pole P or located near the pole P; the first to third pentagonal groups B1 to B3 spaced at intervals of 120° are located at a relatively high latitude; and the total number of dimples is 372. The remaining features are substantially the same as in the first embodiment.

Figure 5:
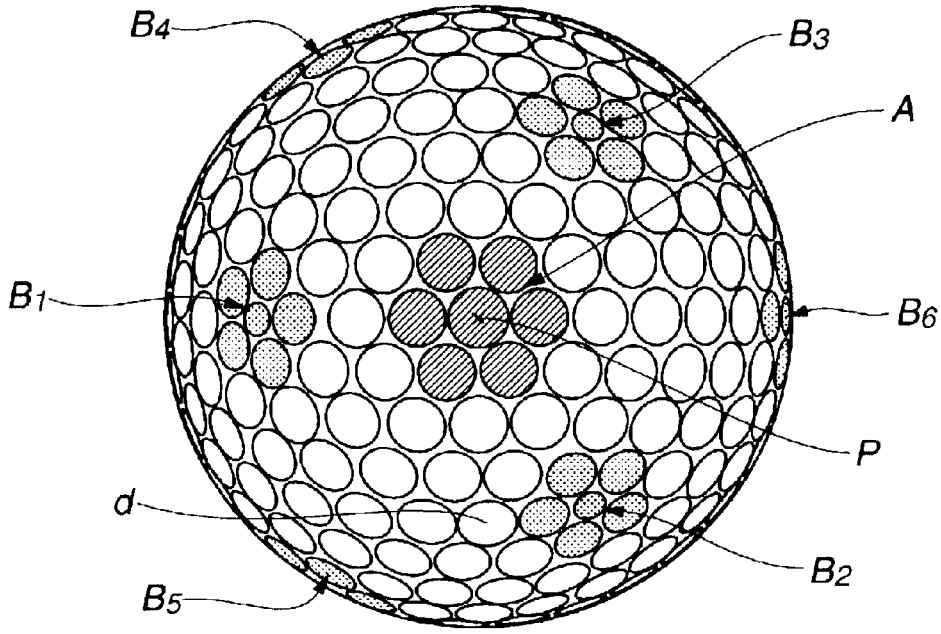
FIG. 5 is a plan view, as viewed from above the pole, of a golf ball according to a third embodiment of the invention.
Figure 6:
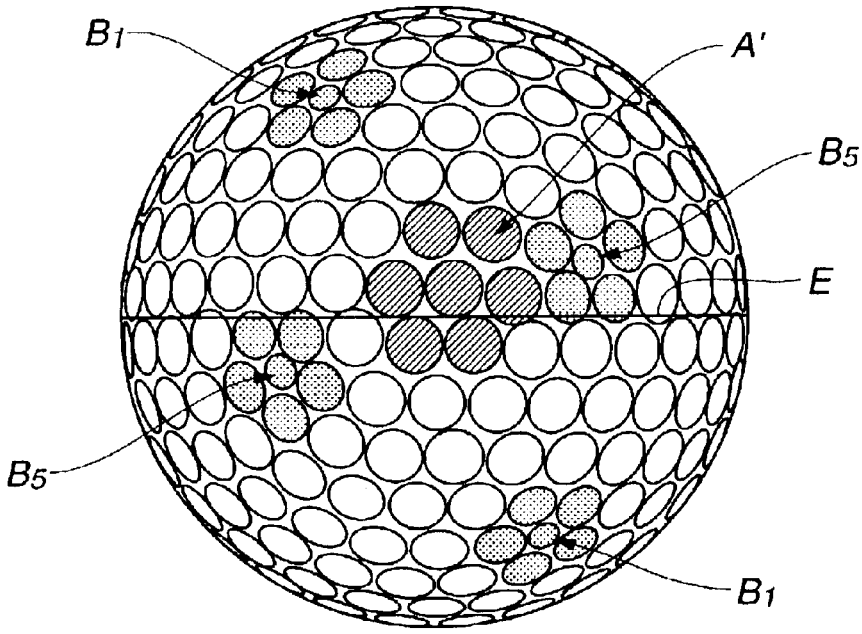
FIG. 6 is a side view, as viewed from above the equator, of the golf ball of FIG. 5.

FIGS. 5 and 6 illustrate a golf ball according to the third embodiment of the invention. FIG. 5 is a plan view of the ball as viewed from above the pole P. FIG. 6 is a side view of the ball as viewed from above the equator E. The third embodiment is characterized in that the first to third pentagonal groups B1 to B3 are located at a relatively high latitude as in the above embodiment, and the total number of dimples is 368. The remaining features are substantially the same as in the first embodiment.

Figure 7:
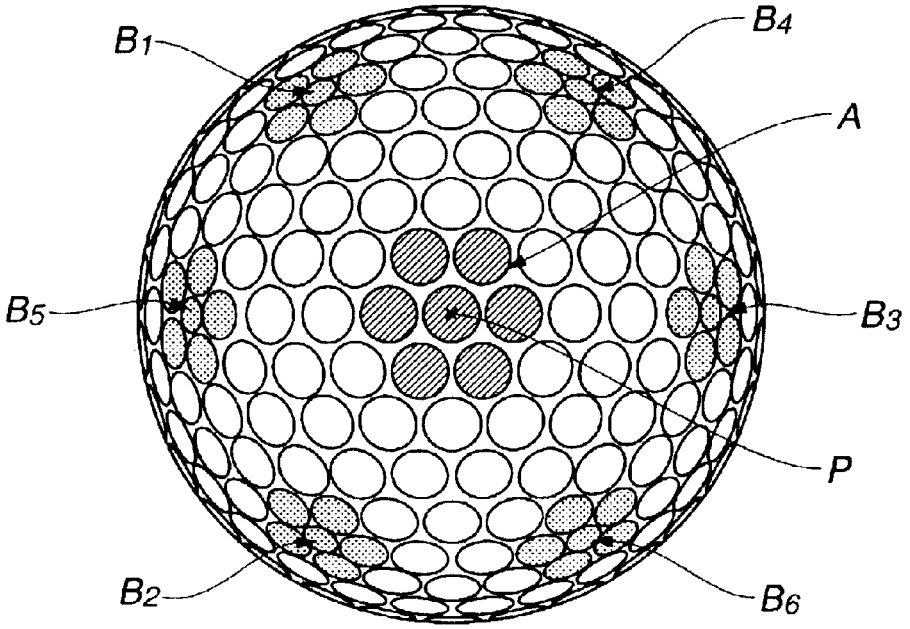
FIG. 7 is a plan view, as viewed from above the pole, of a golf ball according to a fourth embodiment of the invention.
Figure 8:
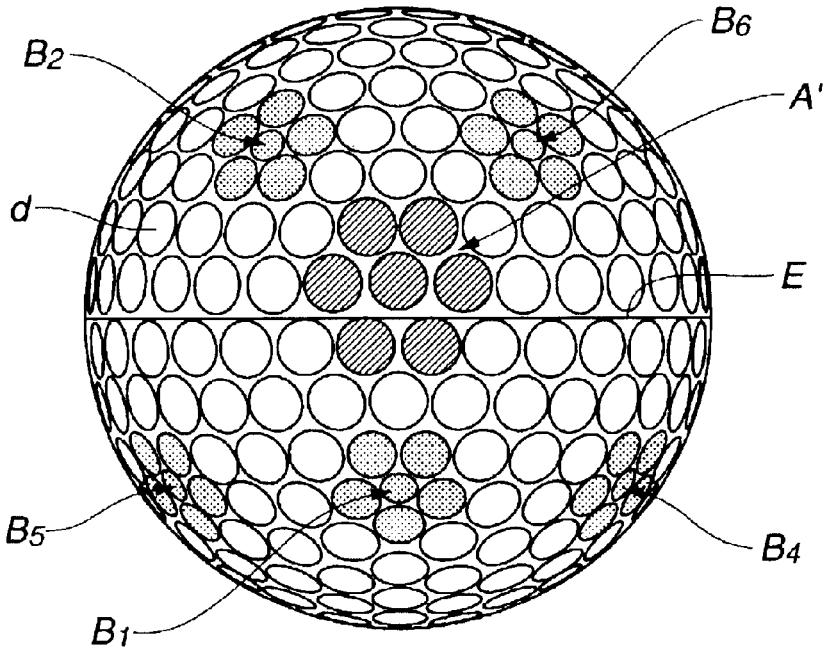
FIG. 8 is a side view, as viewed from above the equator, of the golf ball of FIG. 7.

FIGS. 7 and 8 illustrate a golf ball according to the fourth embodiment of the invention. FIG. 7 is a plan view of the ball as viewed from above the pole P. FIG. 8 is a side view of the ball as viewed from above the equator E. The fourth embodiment is characterized in that the first to third pentagonal groups B1 to B3 and the fourth to sixth pentagonal dimples groups B4 to B6, both spaced at intervals of 120°, are located at substantially the same latitude, the arrangement of dimples on the equator E is avoided, and the total number of dimples is 362. The remaining features are substantially the same as in the first embodiment.

Figure 9:
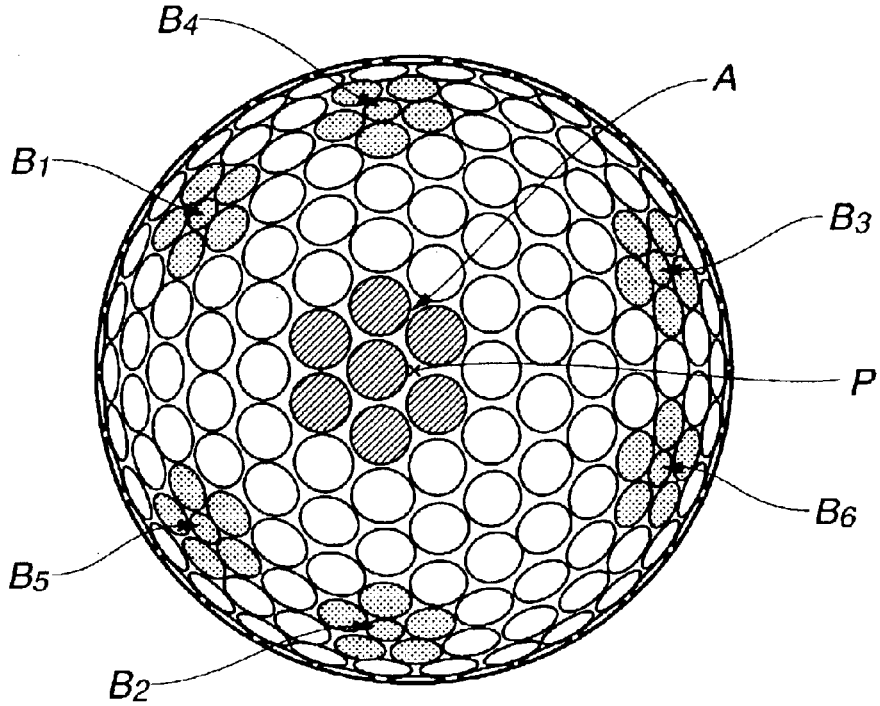
FIG. 9 is a plan view, as viewed from above the pole, of a golf ball according to a fifth embodiment of the invention.
Figure 10:
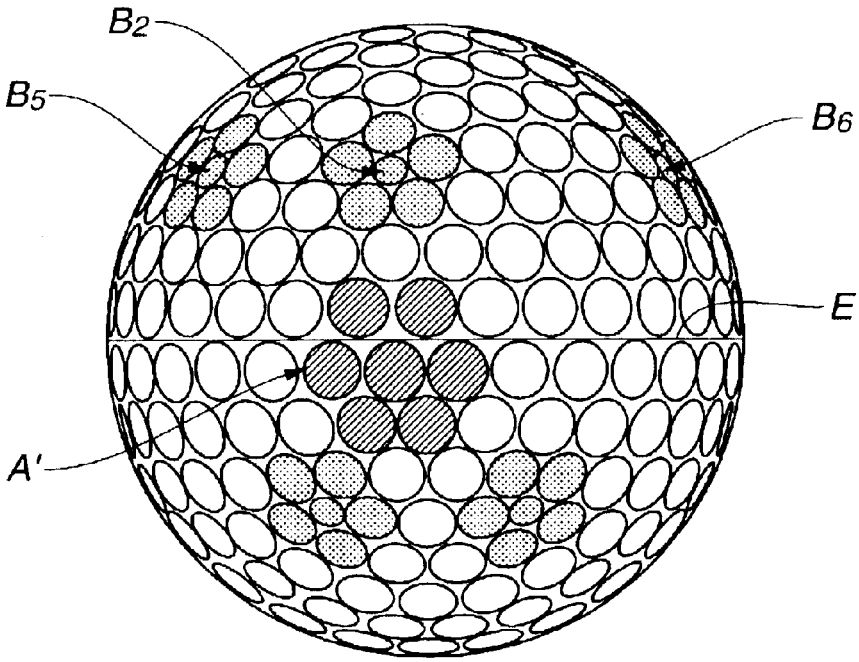
FIG. 10 is a side view, as viewed from above the equator, of the golf ball of FIG. 9.

FIGS. 9 and 10 illustrate a golf ball according to the fifth embodiment of the invention. FIG. 9 is a plan view of the ball as viewed from above the pole P. FIG. 10 is a side view of the ball as viewed from above the equator E. The fifth embodiment is characterized in that the center of the hexagonal group in the polar area is offset from the pole P as in the second embodiment; the first to third pentagonal groups B1 to B3 and the fourth to sixth pentagonal dimples groups B4 to B6, both spaced at intervals of 120°, are located at substantially the same latitude; the arrangement of dimples on the equator E is avoided; and the total number of dimples is 360. The remaining features are substantially the same as in the second embodiment. As opposed to the second embodiment (FIGS. 3 and 4) wherein a phase difference of 60° is set between the first to third pentagonal dimples groups B1 to B3 and the fourth to sixth pentagonal dimples groups B4 to B6 on each hemisphere, the fifth embodiment (FIGS. 9 and 10) is also characterized in that the spacing between the first to third pentagonal dimples groups B1 to B3 and the fourth to sixth pentagonal dimples groups B4 to B6 is alternately wide and narrow, i.e., unequal spacing.

Figure 11:
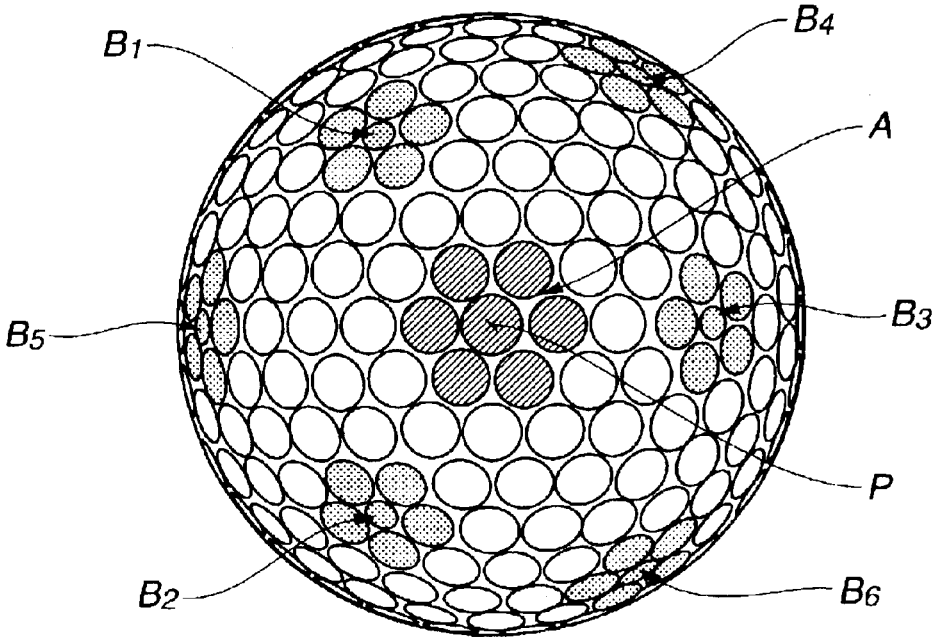
FIG. 11 is a plan view, as viewed from above the pole, of a golf ball according to a sixth embodiment of the invention.
Figure 12:
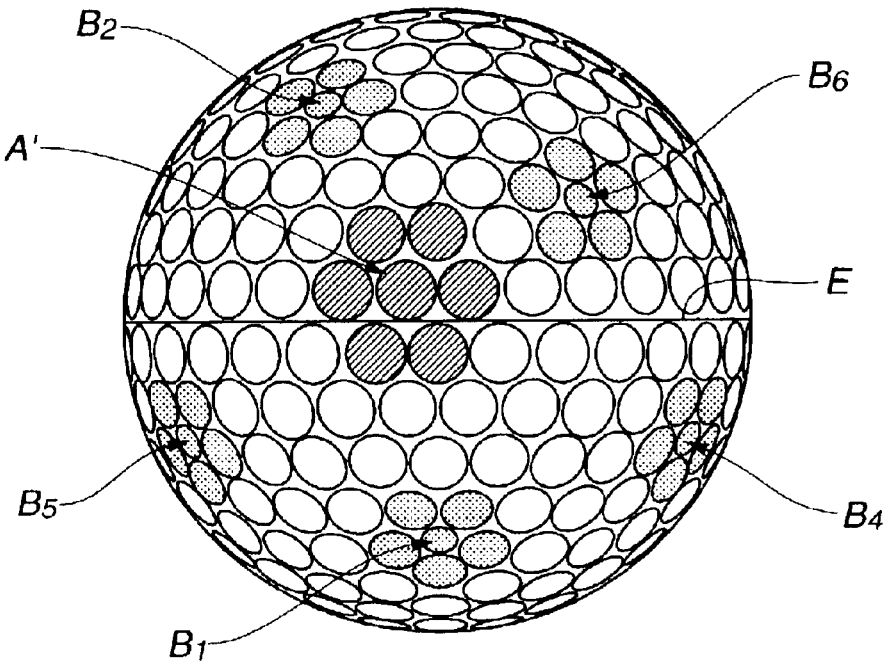
FIG. 12 is a side view, as viewed from above the equator, of the golf ball of FIG. 11.

FIGS. 11 and 12 illustrate a golf ball according to the sixth embodiment of the invention. FIG. 11 is a plan view of the ball as viewed from above the pole P. FIG. 12 is a side view of the ball as viewed from above the equator E. The sixth embodiment is characterized in that the first to third pentagonal dimples groups B1 to B3 are located at a relatively high latitude, the arrangement of dimples on the equator E is avoided, and the total number of dimples is 356. The remaining features are substantially the same as in the first embodiment.

Figure 13:
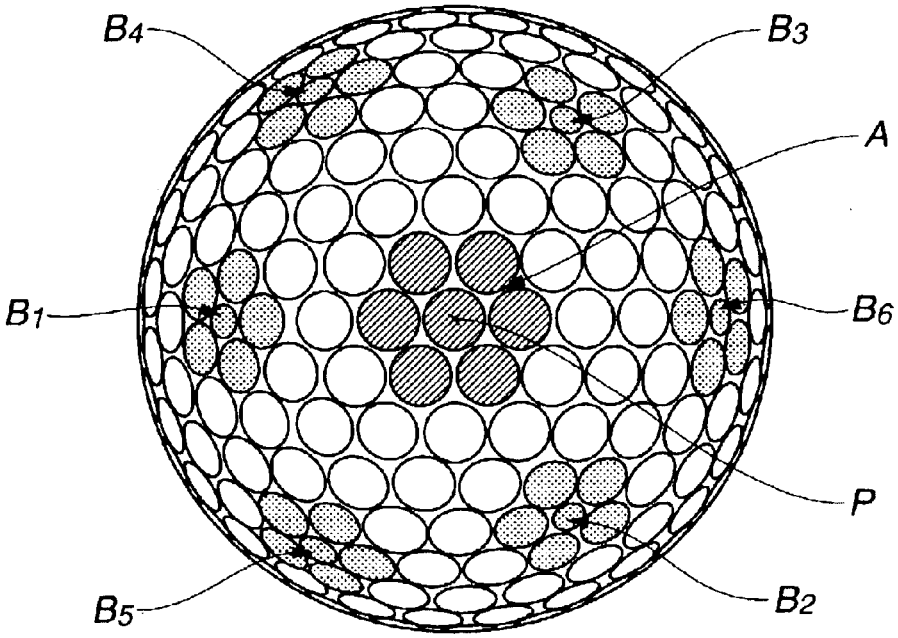
FIG. 13 is a plan view, as viewed from above the pole, of a golf ball according to a seventh embodiment of the invention.
Figure 14:
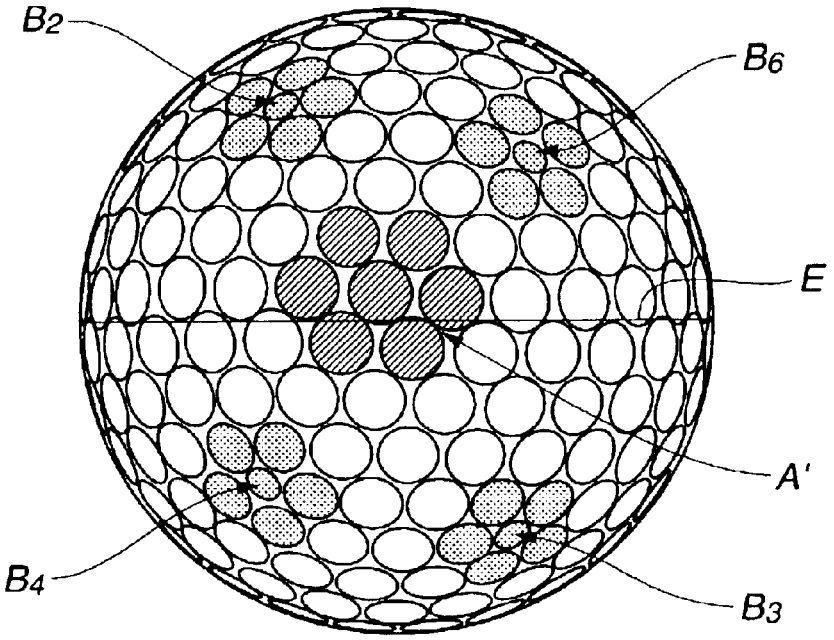
FIG. 14 is a side view, as viewed from above the equator, of the golf ball of FIG. 13.

FIGS. 13 and 14 illustrate a golf ball according to the seventh embodiment of the invention. FIG. 13 is a plan view of the ball as viewed from above the pole P. FIG. 14 is a side view of the ball as viewed from above the equator E. The seventh embodiment is characterized in that the first to third pentagonal dimples groups B1 to B3 and the fourth to sixth pentagonal dimples groups B4 to B6 are located at relatively high latitudes, and the total number of dimples is 338. The remaining features are substantially the same as in the first embodiment.

Figure 15:
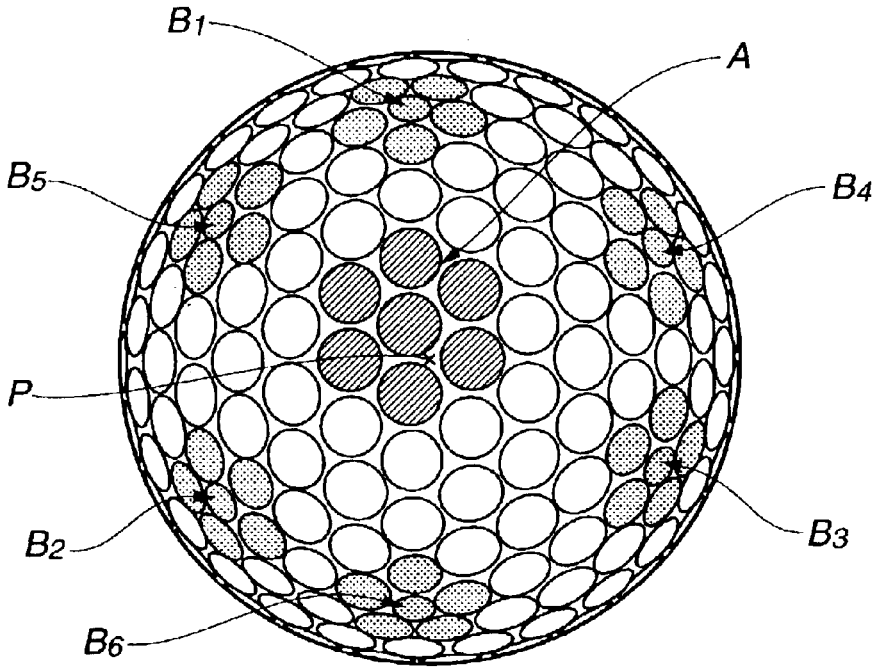
FIG. 15 is a plan view, as viewed from above the pole, of a golf ball according to an eighth embodiment of the invention.
Figure 16:
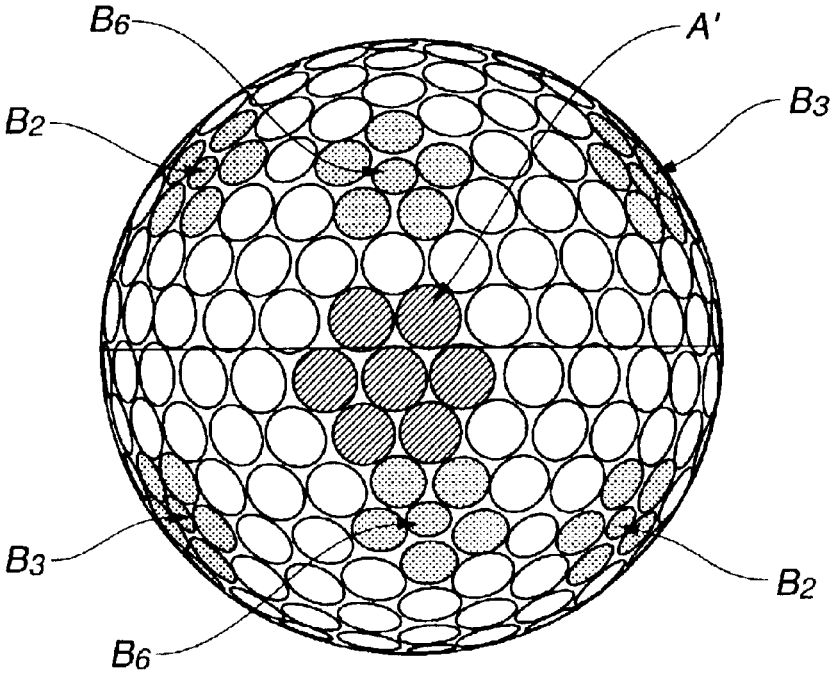
FIG. 16 is a side view, as viewed from above the equator, of the golf ball of FIG. 15.

FIGS. 15 and 16 illustrate a golf ball according to the eighth embodiment of the invention. FIG. 15 is a plan view of the ball as viewed from above the pole P. FIG. 16 is a side view of the ball as viewed from above the equator E. The eighth embodiment is substantially the same as the fifth embodiment (FIGS. 9 and 10) except that the total number of dimples is 312 and those dimples located near the equator lie across the equator E.

Figure 17:
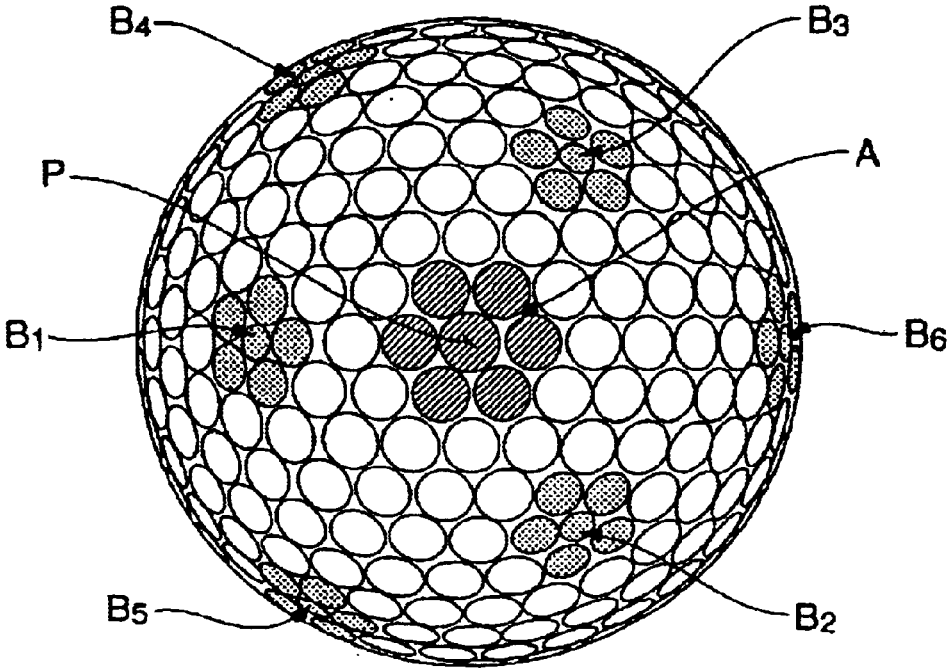
FIG. 17 is a plan view, as viewed from above the pole, of a golf ball according to a ninth embodiment of the invention.
Figure 18:
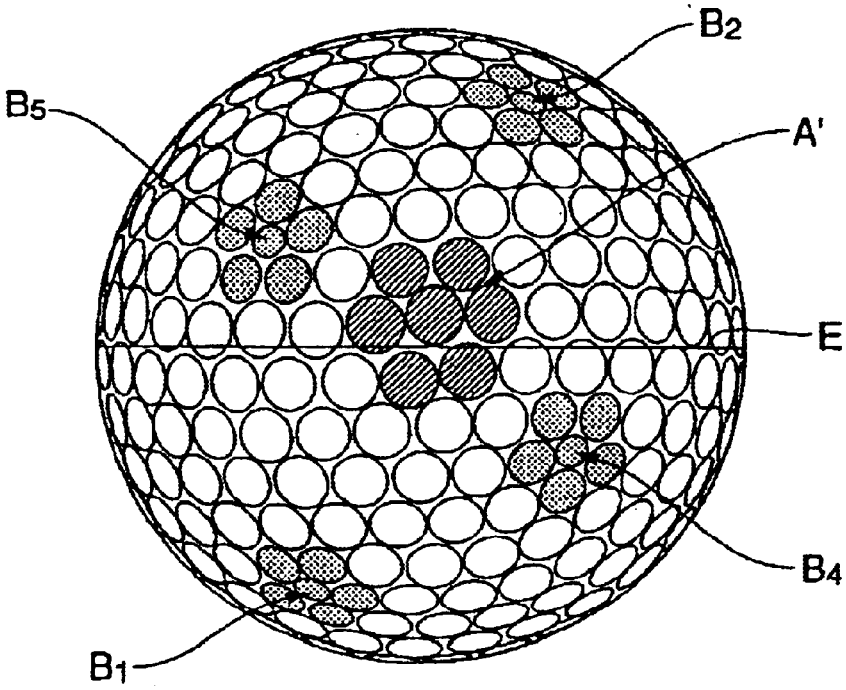
FIG. 18 is a side view, as viewed from above the equator, of the golf ball of FIG. 17.

FIGS. 17 and 18 illustrate a golf ball according to the ninth embodiment of the invention. FIG. 17 is a plan view of the ball as viewed from above the pole P. FIG. 18 is a side view of the ball as viewed from above the equator E. The ninth embodiment is substantially the same as the third embodiment of FIGS. 5 and 6 except that the total number of dimples is increased to 434.

Figure 19:
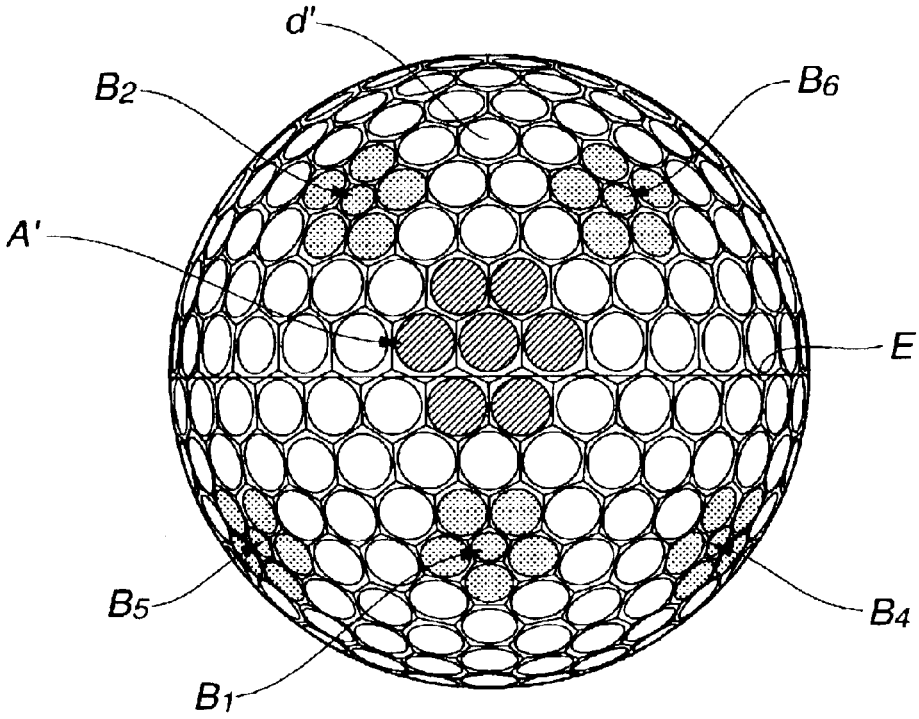
FIG. 19 is a plan view, as viewed from above the pole, of a golf ball according to a tenth embodiment of the invention.
Figure 20:
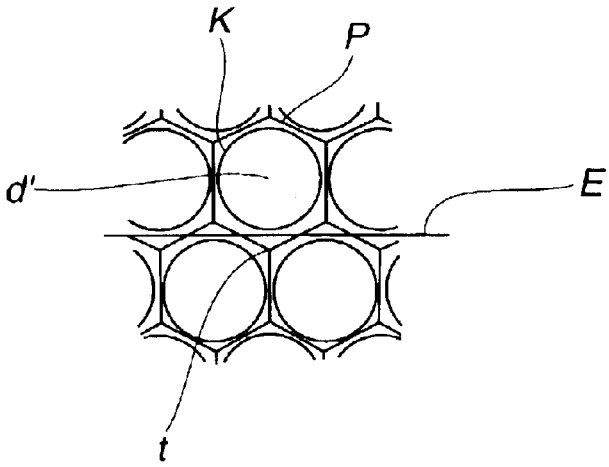
FIG. 20 is an enlarged view of some dimples on the golf ball of FIG. 19.

FIGS. 19 and 20 illustrate a golf ball according to the tenth embodiment of the invention. FIG. 19 is a plan view of the ball as viewed from above the equator E. FIG. 20 is an enlarged view of several dimples.

Although the arrangement pattern and total number of dimples in the tenth embodiment are the same as those in the fourth embodiment of FIGS. 7 and 8, the shape of dimples is different. In the fourth embodiment of FIGS. 7 and 8, each dimple d is circular in planar shape and as viewed in radial cross section, though not depicted, the dimple is concave-wall-shaped to draw an arcuate curve from the edge of the dimple (defining a boundary with the land providing the outer surface of the ball) to the central deepest bottom of the dimple so that the dimple depth progressively increases from the edge to the bottom. Then the boundary between the side wall and the bottom of the dimple is indefinite. The wall shape of circular dimples is common to the first to ninth embodiments. On the other hand, the land of the ball interposed between two adjacent circular dimples forms a very narrow strip of constricted shape whereas the land of the ball surrounded by three adjacent circular dimples forms a relatively wide curved area of triangular shape.

In contrast, in the tenth embodiment of FIGS. 19 and 20, the edges P delimiting a dimple d' extend linearly to define together a hexagonal shape (meaning that dimple d' is a hexagonal dimple), and side walls K form inclined surfaces toward the circular bottom. The bottom is not limited to the circular shape in a plan view and may be formed to a hexagonal shape (similar to the edges P) or any other shape. With respect to the land, the land of the ball interposed between two adjacent dimples d' can be uniformly narrow throughout its length, and the width of the land can be narrowed to a linear land as long as the object of the invention is not compromised. The same applies to the land of the ball surrounded by three adjacent dimples, that is, the land can be narrowed to a point as shown at t in FIG. 20.

The bottom shape of dimple d' in the tenth embodiment, though not depicted in FIGS. 19 and 20, is formed to a convex arcuate shape extending parallel to the arcuate shape of the ball surface. The bottom shape of hexagonal dimples is not limited to the convex arcuate shape, but may be formed flat or concave like the circular dimples.

In the fourth embodiment having the same dimple arrangement as in the tenth embodiment, an endless land strip is formed at the equator E of the ball as shown in FIG. 8. In the tenth embodiment wherein the dimples are formed to hexagonal shape, some dimples intersect with the equator E in a zigzag manner as shown in FIG. 19. In this embodiment of hexagonal dimple arrangement, it becomes easy to eliminate a great circle that does not intersect with dimples (including the position of the equator) and it becomes possible to increase the total dimple area relative to the ball surface to the maximum.

It is noted that in the tenth embodiment of FIGS. 19 and 20, the dimple located at the center of the pentagonal group Bn is formed to a pentagonal shape unlike the surrounding five hexagonal dimples.

Figure 21:
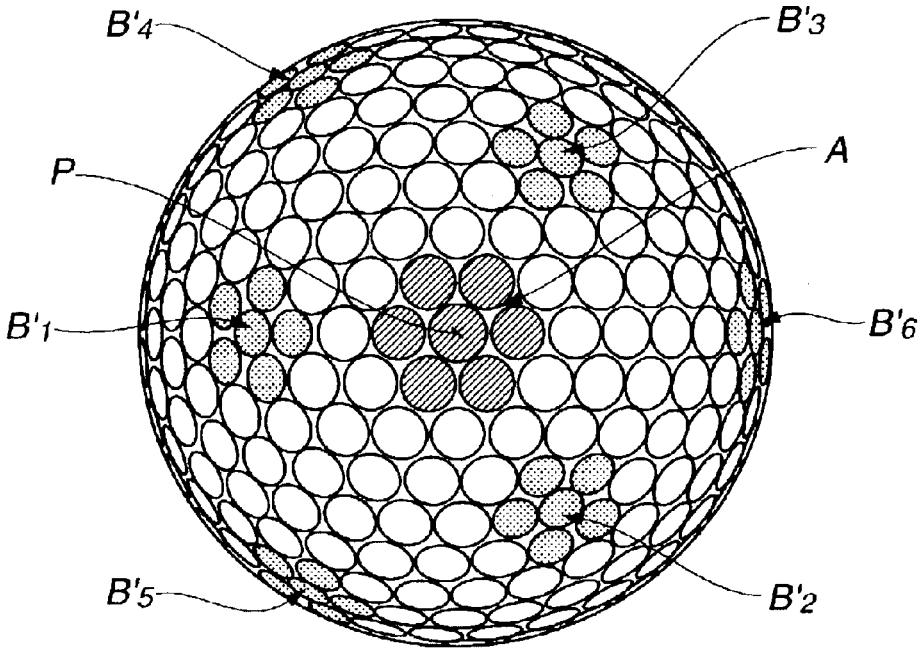
FIG. 21 is a plan view, as viewed from above the pole, of a golf ball according to an eleventh embodiment of the invention.

FIG. 21 illustrates a golf ball according to the eleventh embodiment of the invention, as viewed from above the pole P. The eleventh embodiment uses the same dimple arrangement as the ninth embodiment of FIG. 17, but differs from the ninth embodiment in that the dimple located at the center of the first to sixth pentagonal groups B'1 to B'6 has substantially the same size (diameter) as the surrounding five dimples.

Although the embodiment wherein the pentagonal group consists of dimples of the same size has the tendency that the mutual spacing between five surrounding dimples (the width of the land separating the adjacent dimples) becomes relatively wide, the overall uniform arrangement of dimples remains unchanged from the dimple arrangement of the ninth embodiment (FIG. 17). For the same reason, the central dimple of the pentagonal group can be larger than the surrounding five dimples as long as the object of the invention is not compromised.

The inventive golf ball ensures that dimples are uniformly and densely distributed over the ball surface to reduce the air resistance of the ball in flight, leading to an increased flight distance.

EXAMPLE

Examples of the invention are given below by way of illustration and not by way of limitation.

Examples 1–10 & Comparative Example 1

Golf balls of Examples 1 to 10 and Comparative Example 1 were prepared as solid golf balls of three-layer structure using a monolithic core of rubber, an intermediate layer made of a mixture of an ionomer resin and an olefin elastomer, and a cover of a polyurethane elastomer compound. In all the balls, the intermediate layer had a gage of 1.65 mm, the intermediate layer had a Shore D hardness of 61 as measured on its outer surface, the cover had a gage of 1.5 mm, and the cover had a Shore D hardness of 58 as measured on the land of the ball surface.

Examples 1 to 10 correspond to the first to tenth embodiments described above, respectively, and the dimples used in these Examples are based on FIGS. 1 to 20. The dimensions of dimples of different types used in Examples are shown in Table 1. The golf ball of Comparative Example 1 has the dimple arrangement shown in FIGS. 22 and 23 which are a plan view from above the pole P and a side view from above the equator E, respectively. In the dimple arrangement of Comparative Example 1, dimples in a total number of 432 are uniformly distributed and one great circle that does not intersect with dimples extends along the equator. The dimensions of dimples of different types used in Comparative Example 1 are also shown in Table 1.

The golf balls of Examples 1 to 10 and Comparative Example 1 were examined by the tests described below.

In a flight performance test, the ball was hit ten times by means of a hitting machine equipped with a driver (W#1) under conditions: an initial velocity of 67 m/s and a launch angle of 10°. An average of carry (m) and total distance (m) was calculated.

In a flight uniformity test, the ball was hit ten times under the same conditions as in the flight performance test. For evaluating the uniformity of trajectory, a variation of elevation angle was measured as a difference between maximum and minimum elevation angles. The ball was rated to have flight uniformity (o) when the variation was within 0.3° and to be non-uniform (χ) when more than 0.3°.

The results are shown in Table 2.

TABLE 1

Figure 22:
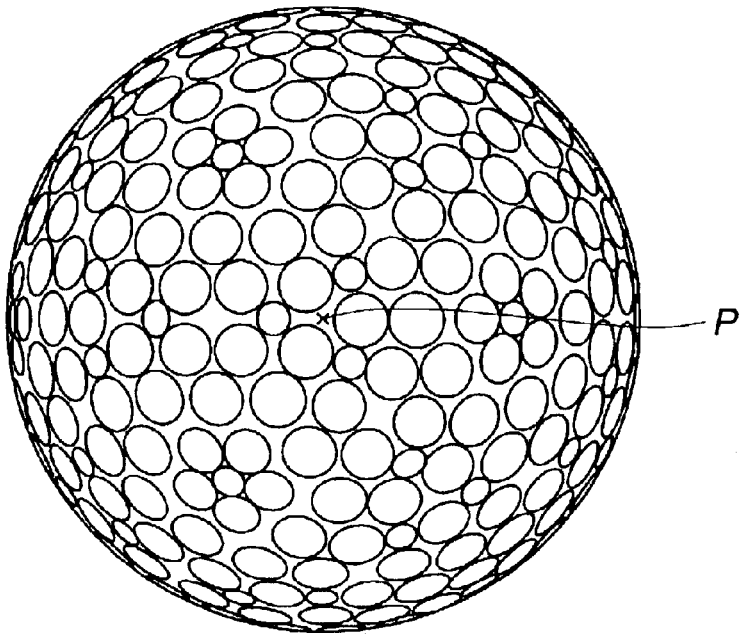
FIG. 22 is a plan view, as viewed from above the pole, of a golf ball of Comparative Example 1.
Figure 23:
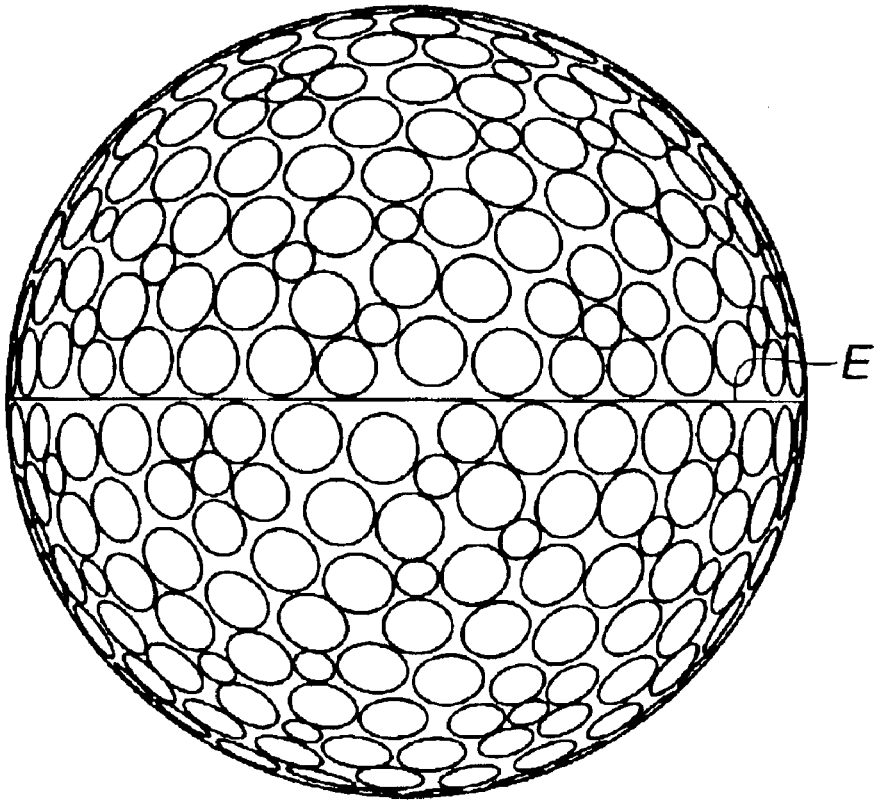
FIG. 23 is a side view, as viewed from above the equator, of the golf ball of FIG. 22.

| | Dimple type | Diameter (mm) | Depth (mm) | Volume ($mm^3$) | Number | | Arrangement FIG. | Total volume ($mm^3$) | Dimple area relative to ball surface (%) |
|---|---|---|---|---|---|---|---|---|---|
| Example | | | | | | | | | |
| 1 | ① | 4.1 | 0.16 | 1.014 | 200 | total | FIGS. 1, 2 | 328 | 77.5 |
| | ② | 3.8 | 0.15 | 0.817 | 72 | 380 | | | |
| | ③ | 3.4 | 0.14 | 0.610 | 12 | | | | |
| | ④ | 2.5 | 0.10 | 0.236 | 96 | | | | |
| 2 | ① | 4.1 | 0.15 | 0.951 | 300 | 372 | FIGS. 3, 4 | 324 | 80.2 |
| | ② | 3.5 | 0.13 | 0.600 | 60 | | | | |
| | ③ | 2.4 | 0.10 | 0.217 | 12 | | | | |
| 3 | ① | 4.1 | 0.16 | 0.972 | 296 | 368 | FIGS. 5, 6 | 332 | 79.8 |
| | ② | 3.6 | 0.15 | 0.702 | 60 | | | | |
| | ③ | 2.4 | 0.10 | 0.208 | 12 | | | | |
| 4 | ① | 4.1 | 0.16 | 1.014 | 290 | 362 | FIGS. 7, 8 | 333 | 77.9 |
| | ② | 3.5 | 0.13 | 0.600 | 60 | | | | |
| | ③ | 2.5 | 0.10 | 0.236 | 12 | | | | |
| 5 | ① | 4.1 | 0.16 | 1.014 | 288 | 360 | FIGS. 9, 10 | 336 | 78.1 |
| | ② | 3.6 | 0.14 | 0.684 | 60 | | | | |
| | ③ | 2.5 | 0.10 | 0.236 | 12 | | | | |
| 6 | ① | 4.1 | 0.16 | 0.951 | 284 | 356 | FIGS. 11, 12 | 316 | 77.8 |
| | ② | 3.7 | 0.15 | 0.726 | 60 | | | | |
| | ③ | 2.5 | 0.10 | 0.221 | 12 | | | | |
| 7 | ① | 4.3 | 0.17 | 1.111 | 254 | 338 | FIGS. 13, 14 | 340 | 79.7 |
| | ② | 3.8 | 0.15 | 0.766 | 72 | | | | |
| | ③ | 2.5 | 0.10 | 0.221 | 12 | | | | |
| 8 | ① | 4.5 | 0.15 | 1.074 | 234 | 312 | FIGS. 15, 16 | 308 | 80.9 |
| | ② | 4.0 | 0.14 | 0.792 | 66 | | | | |
| | ③ | 3.0 | 0.12 | 0.302 | 12 | | | | |
| 9 | ① | 3.9 | 0.15 | 0.824 | 362 | 434 | FIGS. 17, 18 | 331 | 85.4 |
| | ② | 3.3 | 0.13 | 0.511 | 60 | | | | |
| | ③ | 2.4 | 0.10 | 0.208 | 12 | | | | |
| 10 | ① | 4.2 | 0.15 | 0.999 | 292 | 362 | FIGS. 19, 20 | 327 | 88.6 |
| | ② | 3.4 | 0.13 | 0.580 | 60 | | | | |
| | ③ | 2.4 | 0.10 | 0.232 | 12 | | | | |
| Comparative Example 1 | ① | 3.9 | 0.16 | 0.917 | 288 | 432 | FIGS. 22, 23 | 321 | 76.5 |
| | ② | 3.3 | 0.14 | 0.575 | 72 | | | | |
| | ③ | 2.4 | 0.10 | 0.217 | 72 | | | | |

Note 1:

Dimples of types ① and ② in Example 10 are of hexagonal shape, and the distance between two parallel sides is regarded as the diameter.

Note 2:

Dimples of type ③ in Example 10 are of pentagonal shape, and the distance between alternate internal peaks is regarded as the diameter.

TABLE 2

| | | Example | | | | | | | | | | Comparative |
|---|---|---|---|---|---|---|---|---|---|---|---|---|
| | | 1 | 2 | 3 | 4 | 5 | 6 | 7 | 8 | 9 | 10 | Example |
| Flight distance @ W #1 | Carry (m) | 218 | 218 | 217 | 216 | 216 | 219 | 215 | 216 | 219 | 219 | 216 |
| | Total (m) | 240 | 239 | 240 | 238 | 238 | 237 | 237 | 237 | 241 | 240 | 237 |
| Uniformity | | ○ | ○ | ○ | ○ | ○ | ○ | ○ | ○ | ○ | ○ | X |

As is evident from the test results in Table 2, the golf balls of Examples 1 to 10 show increased flight distance and flight uniformity whereas the golf ball of Comparative Example 1 is inferior in flight distance and uniformity.

Japanese Patent Application Nos. 2002-114913 and 2002-188968 are incorporated herein by reference.

Reasonable modifications and variations are possible from the foregoing disclosure without departing from either the spirit or scope of the present invention as defined by the claims.

What is claimed is:

1. A golf ball having a pair of poles and a plurality of dimples on its surface, wherein twelve pentagonal groups each consisting of five dimples arranged about one central dimple are dispersively distributed over the ball surface excluding the polar areas, and hexagonal groups each consisting of six dimples arranged about one central dimple are distributed over the remaining area of the ball surface.

2. The golf ball of claim 1 wherein the central dimple of the hexagonal group is located at or near either pole of the ball.

3. The golf ball of claim 1 wherein a portion of the pentagonal group constitutes a portion of the hexagonal group.

4. The golf ball of claim 1 wherein except for those dimples located at the center of the pentagonal groups, the dimple edges delimiting each dimple define a hexagonal shape.

5. The golf ball of claim 1 which has between the pair of poles an equator by which the ball is divided into a pair of hemispheres, six pentagonal groups are dispersively distributed on one hemisphere and six pentagonal groups are dispersively distributed on the other hemisphere.

6. The golf ball of claim 1 wherein the pentagonal groups are distributed in symmetry with respect to an axis of rotation that connects the pair of poles.

7. The golf ball of claim 1 wherein the total of dimple areas accounts for at least 77% of the entire surface area of the golf ball.

8. The golf ball of claim 1 wherein in the pentagonal group, the central dimple is smaller than the surrounding dimples.

9. The golf ball of claim 1 wherein in the pentagonal group, the central dimple is not smaller than the surrounding dimples.

* * * * *